US008018161B2

(12) United States Patent
Smith, III et al.

(10) Patent No.: US 8,018,161 B2
(45) Date of Patent: Sep. 13, 2011

(54) LIGHT UNIT WITH INTERNAL BACK-UP POWER SUPPLY, COMMUNICATIONS AND DISPLAY

(75) Inventors: Carl Smith, III, Osprey, FL (US); Richard Craig Hall, Sarasota, FL (US); Matthew Veal, Sarasota, FL (US); Robert Fugerer, Sarasota, FL (US)

(73) Assignee: Sunovia Energy Technologies, Inc., Sarasota, FL (US)

( * ) Notice: Subject to any disclaimer, the term of this patent is extended or adjusted under 35 U.S.C. 154(b) by 357 days.

(21) Appl. No.: 12/027,232

(22) Filed: Feb. 6, 2008

(65) Prior Publication Data

US 2009/0039788 A1 Feb. 12, 2009

Related U.S. Application Data

(60) Provisional application No. 60/888,381, filed on Feb. 6, 2007.

(51) Int. Cl.
*H05B 37/00* (2006.01)

(52) U.S. Cl. ..... 315/86; 315/291; 315/307

(58) Field of Classification Search ..... 315/85–87, 315/149, 156, 158, 224, 291, 307
See application file for complete search history.

(56) References Cited

U.S. PATENT DOCUMENTS

| | | | | |
|---|---|---|---|---|
| 4,945,280 | A * | 7/1990 | Beghelli | 315/129 |
| 5,331,353 | A * | 7/1994 | Levenson et al. | 725/29 |
| 5,633,629 | A * | 5/1997 | Hochstein | 340/907 |
| 5,924,784 | A | 7/1999 | Chliwnyj et al. | |
| 6,573,746 | B2 | 6/2003 | Kim et al. | |
| 6,583,719 | B2 | 6/2003 | Okada et al. | |
| 6,628,083 | B2 | 9/2003 | Pickering | |
| 6,710,546 | B2 * | 3/2004 | Crenshaw | 315/86 |
| 7,009,348 | B2 * | 3/2006 | Mogilner et al. | 315/307 |
| 7,148,632 | B2 * | 12/2006 | Berman et al. | 315/189 |
| 2002/0021573 | A1 * | 2/2002 | Zhang | 362/555 |
| 2003/0057884 | A1 * | 3/2003 | Dowling et al. | 315/291 |
| 2006/0006817 | A1 * | 1/2006 | Chason et al. | 315/291 |

OTHER PUBLICATIONS

International Searching Authority, "Written Opinion of the International Searching Authority and the International Search Report," Sep. 11, 2008.

* cited by examiner

*Primary Examiner* — Douglas W Owens
*Assistant Examiner* — Tung X Le
(74) *Attorney, Agent, or Firm* — Holland & Hart LLP

(57) ABSTRACT

A light unit that includes an internal power supply that may be used in the event of an external power failure to provide power to the light unit. In one aspect, the present disclosure provides a lighting apparatus, comprising (a) a power input configured to receive external power from an external power source; (b) a solid state light element that is interconnected to the power input; and (c) a back-up power source that is interconnected to the solid state light element and the power input and that provides power to the solid state light element when the light element is not provided with power from the power input.

14 Claims, 2 Drawing Sheets

LIGHT UNIT WITH INTERNAL BACK-UP POWER SUPPLY, COMMUNICATIONS AND DISPLAY

CROSS-REFERENCE TO RELATED APPLICATIONS

The present application claims priority from U.S. Provisional Patent Application No. 60/888,381, filed on Feb. 6, 2007, the entire disclosure of which is incorporated herein by reference.

FIELD

The present invention related to solid state lighting and, more particularly, to a solid state light unit that includes an internal power supply that may illuminate the light.

BACKGROUND

Solid state lighting, such as Light Emitting Diode ("LED") light units, that may be inserted into electrical sockets, lamps, fixtures, and other electrical outlets are well known. These light units illuminate a dark area when there is electricity freely flowing to the light unit outlet and the light is turned on through a wall switch or other switching device. However, if there is a power outage, or if electricity stops flowing to the associated outlet for any reason, the light goes off and the area is no longer illuminated. In addition, the occurrence of black-outs, brown-outs, rolling black-outs and rolling brown-outs have caused tremendous inconvenience and even death for residents in areas where the utility (electrical) grid experienced an overload and simply shut down.

SUMMARY

The present disclosure provides a light unit that includes an internal power supply that may be used in the event of an external power failure to provide power to the light unit. In one aspect, the present disclosure provides a lighting apparatus, comprising (a) a power input configured to receive external power from an external power source; (b) a solid state light element that is interconnected to the power input; and (c) a back-up power source that is interconnected to the solid state light element and the power input and that provides power to the solid state light element when the light element is not provided with power from the power input.

DETAILED DESCRIPTION

Figure 1:
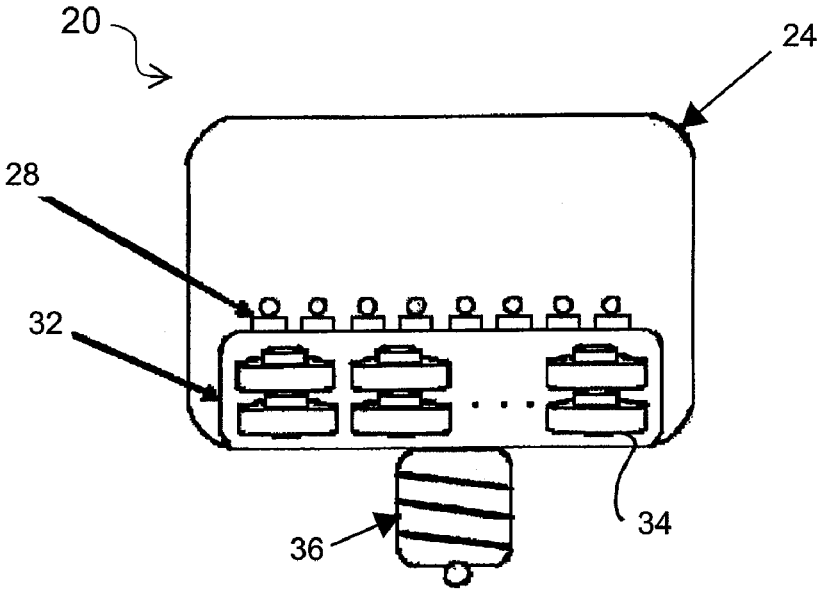
FIG. 1 is an illustration of a light unit of an embodiment of the present disclosure.

For a more complete understanding of this invention, reference is now made to the following detailed description of several exemplary embodiments as illustrated in the drawing figures, in which like numbers represent the same or similar elements. Various exemplary embodiments are described herein, with specific examples provided in many instances to serve to illustrate and discuss various concepts included in the present disclosure. The specific embodiments and examples provided are not necessarily to be construed as preferred or advantageous over other embodiments and/or examples.

Various embodiments provide a light unit that has an internal back-up power source, such as a battery, that is used to illuminate the light unit in the event of a loss of external power. The present disclosure recognizes that in the event of a power failure, it may be desirable to provide illumination to an area using a light unit that is compatible with common household light fixtures. Furthermore, the present disclosure recognizes that events other than a power failure may occur in which it may be desirable to power such an illumination device with internal power, such as during periods where load on a utility's power system is excessive. Various embodiments described herein provide a light unit that may be powered using an internal back-up power source in such situations.

In one exemplary embodiment, a light emitting diode (LED) light unit is adapted to fit into a conventional light socket or outlet, such as the common Edison-type light bulb outlet. The LED light unit includes LEDs that provide desired illumination, and may also include various other elements such as batteries, microprocessors, flexible and/or rigid Printed Circuit Boards ("PCBs"), heat sinks or heat dissipation technologies such as thermally conductive plastics, communications technologies such as wireless like the emerging IEEE 802.15.4 standards, and/or other component technologies. In such a manner, a LED light unit may, for example, switch to battery power when there is no power flowing to the outlet and provide illumination to an area during a power outage. Furthermore, in some embodiments, the LED light unit may be programmed, or instructed by received communications, to switch to battery power during peak electrical demand times, thus reducing the load on a utility (electrical) grid. In still other embodiments, the onboard communications, LEDs, micro-battery backup and micromachines enable an LED light unit that projects graphic information and/or text for a host of advertising applications.

Referring to FIG. 1, a LED light unit 20 of an exemplary embodiment is illustrated. In this embodiment, all components necessary for operation of the unit are located inside of the unit apparatus as illustrated in FIG. 1. In this embodiment, the LED light unit 20 includes a housing 24, that is formed of a transparent material such as clear plastic, although such a housing 24 may be made from numerous types of materials and may be frosted or colored, and may contain reflectors and/or lenses for providing directivity of the light from the light unit 20. Located within the housing 24 are one or more LED elements 28, also referred to herein as an array of LEDs 28. The LED elements 28 may include any suitable type of LED, and in one embodiment are high intensity white LEDs. However, as will be understood by one of skill in the art, other types of LEDs may be utilized depending upon the desired illumination. Furthermore, a light unit may include other types of solid state lighting elements, such as organic light emitting diodes (OLEDs) and/or polymer light emitting diodes. Also included in the housing 24 is a circuit board 32 that includes electronic components to operate the LED elements 28. Also included with the circuit board 32, in the embodiment of FIG. 1, are batteries 34. The LED light unit 20 of FIG. 1 has a base 36 that is adapted to screw into conventional Edison-type sockets.

The component technologies within the LED light unit 20 are programmed, in an exemplary embodiment, to recognize when to switch to battery power. For instance, the LED light unit 20 with battery back-up may recognize and switch to battery power (and illuminate or remain illuminated) when there is a power outage. The LED light unit 20 may also recognize and switch to battery power (and illuminate or remain illuminated) when the public utility electrical grid is at peak usage periods, and it may switch to battery power during other various situations and times. In one embodiment, the LED light unit 20 includes a communications component on the circuit board 32 that operates to receive communications from an external entity, and change the illumination state, or power source for the LED light unit 20. The communications component may receive wireless communications, or may receive communications from the power incoming to the unit. In addition, the utility (electrical) company may recognize a critical spike in electrical usage that could potentially lead to a dangerous power-loss situation, and the utility company could dispatch a signal that is recognized by the components within the light units 20 during such a critical situation which instructs all of the installed light units with battery back-up and communications capabilities within the utility company's service zone to switch to battery back-up. In such a manner, the load on the electrical utility may be decreased.

Although illustrated in FIG. 1 as a typical screw-in light bulb form, numerous other formats may be used in light units of various different embodiments, such as, for example, flood lights, LED globe lights, LED tube lights, etc., where at least one LED is present within the light enclosure and the light unit is adapted to be installed in a conventional manner to the appropriate power outlet or receptacle. As illustrated in FIG. 1, the electronic components, such as a microprocessor, batteries, PCBs, and other electrical components and circuitry are located within the light unit 20. In one embodiment, various electronic components are located within the base 36, and are separated from the bulb section (where the array of LEDs 28 are located) by a heat dissipation element. The heat dissipation element separates the array of LEDs 28 from the component technologies, and includes heat conductive materials and dissipation components that protect the heat-sensitive component technologies within the base 36 of the light unit 20 from the heat that may be generated by the array of LEDs 28. The array of LEDs 28 may be all of one color or of different colors and may be arranged in such a way inside of the unit whereby they one or more individual LED elements are selectively illuminated to spell a word or create a design. Individual LED elements in the array of LEDs 28 may be lit in a sequence to provide an eye-catching display.

Figure 2:
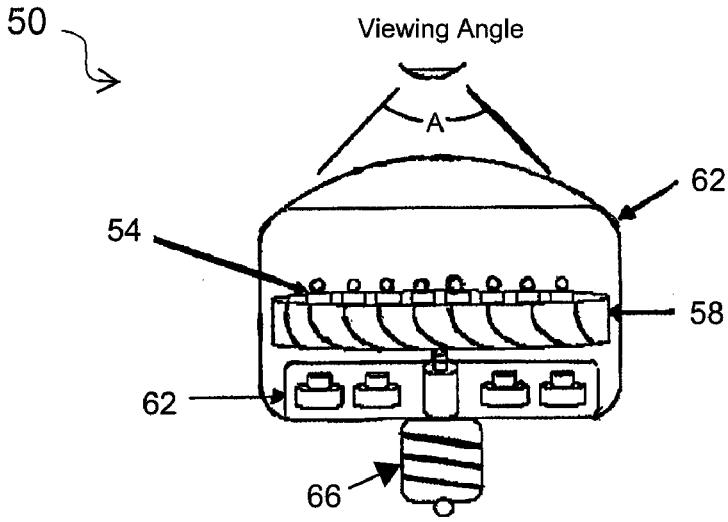
FIG. 2 is an illustration of a light unit of an embodiment of the present disclosure.

While illustrated and described with respect to light emitting diodes, other types of light elements may be used. Additionally, in another exemplary embodiment illustrated in FIG. 2, a LED light unit 50 includes an array of LEDs 54 that are mounted on a rotating disk 58 within housing 62. Such a rotating disk 58 may be manufactured using a micro-machined motor assembly. Such a configuration creates a cooling effect, and may also be used to generate multiple variable messages and eye-catching patterns by controlling the sequencing of the LEDs 54 as the disk 58 rotates. The LED light unit 50, also includes a circuit board, battery housing, and motor housing, designated generally as 62, and a base 66. Similarly as described above, various different configurations are possible for types and locations of various elements. The LED light unit 50 has a viewing angle A that may be selected to provide a desired field of view for the LEDs 54 within the unit.

Figure 3:
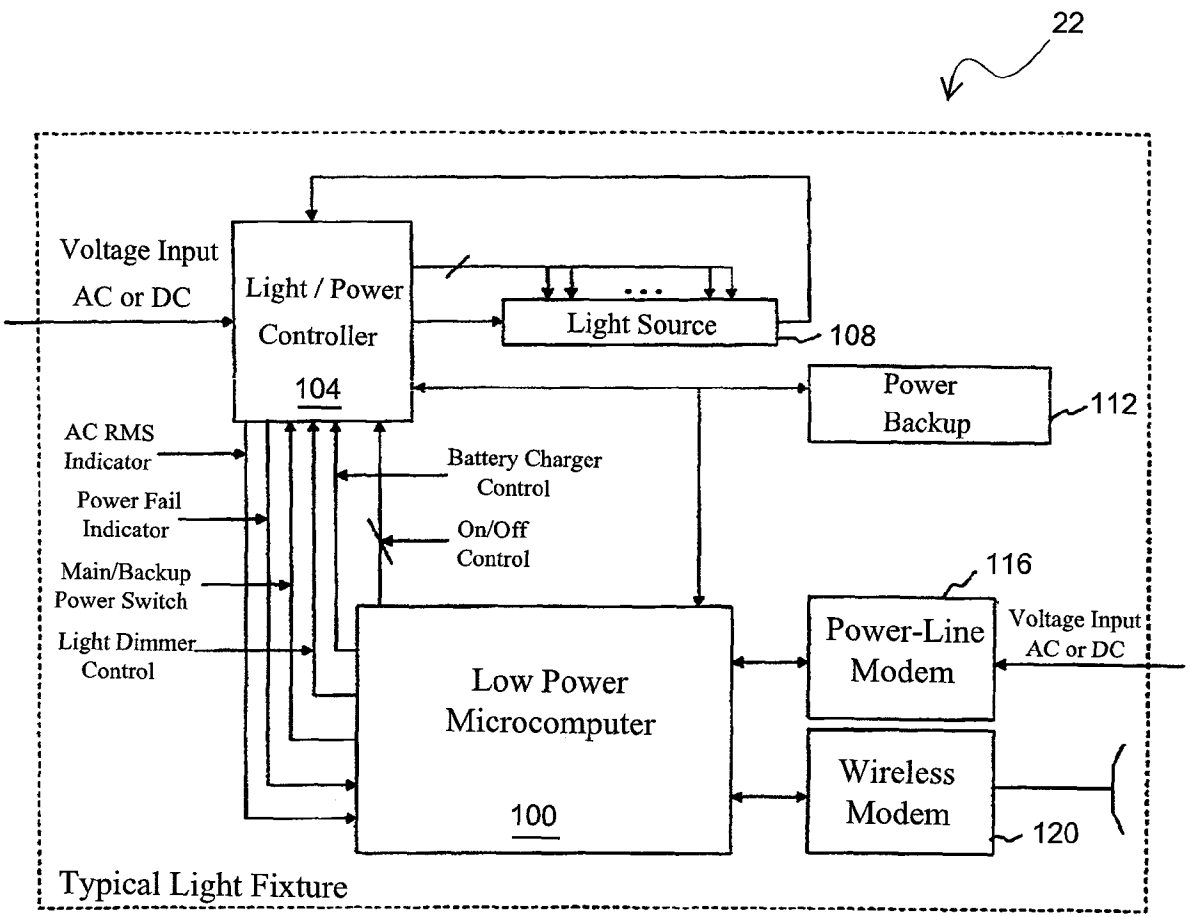
FIG. 3 is a block diagram illustration of the components of a light unit of an embodiment.

With reference now to FIG. 3, a top level functional block diagram of an LED light unit 20 is described for an exemplary embodiment. As described above, the components are included in a light unit that may be adapted to fit into traditional light sockets, thus providing a unit that may replace, for example, a traditional incandescent light bulb or a traditional fluorescent tube light. Included is a low power microcomputer 100 or microprocessor, a light/power controller 104, a light source 108 that, in an embodiment includes one or more LEDs, a backup power source 112, and communications portions that in this example include a power-line modem 116 and a wireless modem 120. The microcontroller 100 or microprocessor may include any suitable device and also may include memory that stores operating instructions or programming for the light unit 20. The light/power controller may provide power to the light source 108, and to individual elements in the light source 108, through a parallel or serial power connection. It will be understood that other embodiments may include one or both of a power-line modem 116 and a wireless modem 120. The light/power controller 104 of this embodiment does a number of things under microprocessor 100 control, such as (1) converting incoming alternating current to direct current to power the light source 108; (2) detecting wall switch open/closed and providing an indication of the same to the microprocessor; (3) providing an alternating current signal level to the microprocessor; (4) switching between back-up DC power and AC to DC power; and (5) switching back-up power source charging voltage on/off. The light source 108 may be a series or parallel connected array of LEDs under microprocessor 100 control. The low power microcomputer 100, in an embodiment, receives messages from Zigbee or other wireless 120 and/or power-line 116 modems and executes light functions based on the received messages. The microcomputer 100, in various embodiments, also sends status messages over wireless modem 120. While both a power-line modem 116 and a wireless modem 120 are illustrated in FIG. 3, such a light unit 20 may include just one type of modem, or may also include just a receiver that receives incoming communications and provides such communications to the microcomputer.

The microcomputer 100 may also monitor the back-up power source 112 and control charging of the back-up power source 112 via the light/power controller 104. The back-up power source 112, in an embodiment, includes a micro-battery backup that includes a suitable battery or batteries. In one embodiment is an array of rechargeable batteries that maintain processor 100 power and power the light source 108 in the event that an external power source is either unavailable or not desired to be used. For example, battery power may be evoked if a message is received through the wireless 120 or power-line 116 modems. Also, if a power-failure is detected, such as when a wall switch is closed but no AC signal, or a weak AC signal, is received at the input to the light/power controller 104, then the battery may power the light unit 20. In one embodiment, if the wall switch is open, the light remains off unless the wireless 120 or power-line 116 modems receive a communications signal indicating otherwise. These modems could also receive communications to control if the light unit 20 is on/off and any effects on the light source 108 such as sequenced lighting of one or more LEDs within the light source 108.

Thus disclosed is a novel LED light unit with battery back-up that may include communications and display capabilities. Such a unit may be inexpensively formed and provide a battery back-up to LED lighting technologies. Although disclosed with respect to the particular embodiments is a LED light unit that is adapted to screw into a typical household bulb socket, it will be readily recognized by one of skill in the art that many other arrangements are within the scope of the invention.

The previous description of the disclosed embodiments is provided to enable a person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A lighting appearatus, comprising:

a housing comprising a base that is insertable into a light socket;

a power input configured to receive external power from an external power source;

a solid state light element that is interconnected to the power input;

a back-up power source that is interconnected to the solid state light element and the power input and that provides power to the solid state light element when the light element is not provided with power from the power input;

a microcontroller within the housing that is interconnected with the power input, solid state light element, and back-up power source, that controls the illumination of the solid state light element; and a modem within the housing that is interconnected with the microcontroller and that receives signals from a source external to the lighting apparatus, the microcontroller controlling the illumination of the light element in response to the received signals.

2. The lighting apparatus, as claimed in claim 1, wherein the microcontroller comprises a memory that has instructions stored therein that, when executed by the microcontroller, cause the microcontroller to illuminate the solid state light element using power from the power input or using power from the back-up power source.

3. The lighting apparatus, as claimed in claim 1, wherein the microcontroller comprises a memory that has instructions stored therein that, when executed by the microcontroller, cause the microcontroller to charge the back-up power source using power from the power input.

4. The lighting apparatus, as claimed in claim 1, wherein when modem comprises a power-line modem that receives signals that are modulated on the power signal from the external power source.

5. The lighting apparatus, as claimed in claim 1, wherein when modem comprises a wireless modem that receives signals from a wireless transmitter that is remote from the lighting apparatus.

6. The lighting apparatus, as claimed in claim 1, wherein the back-up power source comprises a battery.

7. The lighting apparatus, as claimed in claim 1, wherein the solid state light element comprises a light emitting diode.

8. The lighting apparatus, as claimed in claim 7, further comprising a plurality of light emitting diodes.

9. The lighting apparatus, as claimed in claim 8, further comprising a microcontroller to control the illumination of individual light emitting diodes independently of the illumination of the remaining light emitting diodes.

10. The lighting apparatus, as claimed in claim 9, wherein the microcontroller controls illumination of the light emitting diodes to display a predefined pattern of light that is emitted from the lighting apparatus.

11. The lighting apparatus, as claimed in claim 1, wherein the housing base is adapted to be screwed into an Edison-type light socket.

12. The lighting apparatus, as claimed in claim 1, wherein the housing further comprises a transparent dome interconnected to the base, the solid-state light element located within the transparent dome.

13. The lighting apparatus, as claimed in claim 1, wherein the solid state light element provides illumination to a living or work area.

14. The lighting apparatus, as claimed in claim 1, wherein the solid state light element is mounted to a heat sink.

* * * * *